US007398751B2

(12) United States Patent
Kadowaki

(10) Patent No.: US 7,398,751 B2
(45) Date of Patent: Jul. 15, 2008

(54) CONTROL DEVICE FOR ENGINE VALVE AND CONTROL SYSTEM FOR ENGINE

(75) Inventor: Hisashi Kadowaki, Chita-gun (JP)

(73) Assignee: Denso Corporation (JP)

( * ) Notice: Subject to any disclaimer, the term of this patent is extended or adjusted under 35 U.S.C. 154(b) by 12 days.

(21) Appl. No.: 11/712,518

(22) Filed: Mar. 1, 2007

(65) Prior Publication Data

US 2007/0221151 A1 Sep. 27, 2007

(30) Foreign Application Priority Data

Mar. 27, 2006 (JP) ..... 2006-084662

(51) Int. Cl.
*F01L 1/34* (2006.01)

(52) U.S. Cl. ..... 123/90.17; 123/90.15; 123/347; 74/160

(58) Field of Classification Search ..... 123/90.15, 123/90.16, 90.17, 90.18, 90.27, 90.31, 345, 123/346, 347, 348; 464/1, 2, 160
See application file for complete search history.

(56) References Cited

U.S. PATENT DOCUMENTS 5,562,071 A 10/1996 Urushihata et al.
5,957,095 A * 9/1999 Kako ..... 123/90.15

FOREIGN PATENT DOCUMENTS

JP 11-062643 3/1999

* cited by examiner

*Primary Examiner*—Ching Chang
(74) *Attorney, Agent, or Firm*—Nixon & Vanderhye PC

(57) ABSTRACT

A rotational phase difference of a camshaft relative to a crankshaft in a variable valve timing mechanism is controlled by an operation of an oil control valve. That is, in the oil control valve, there is outputted an operational signal which is defined by adding a feedback correction amount corresponding to a difference between an actual value and a target value of the rotational phase difference, to a holding learning value as the operational signal for holding the rotational phase difference. The holding learning value is altered only by a specified value on condition that the operational signal for holding the rotational phase difference is assumed to change.

13 Claims, 7 Drawing Sheets

FIG. 4A
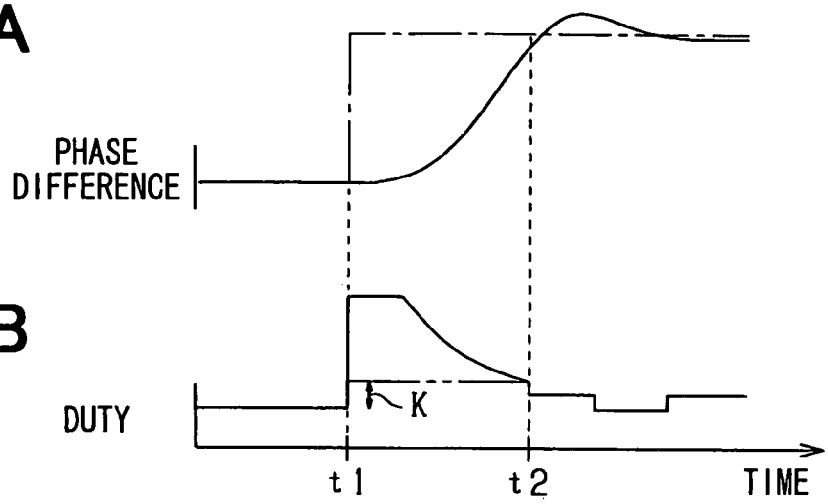
FIG. 4B
FIG. 5A
PRIOR ART
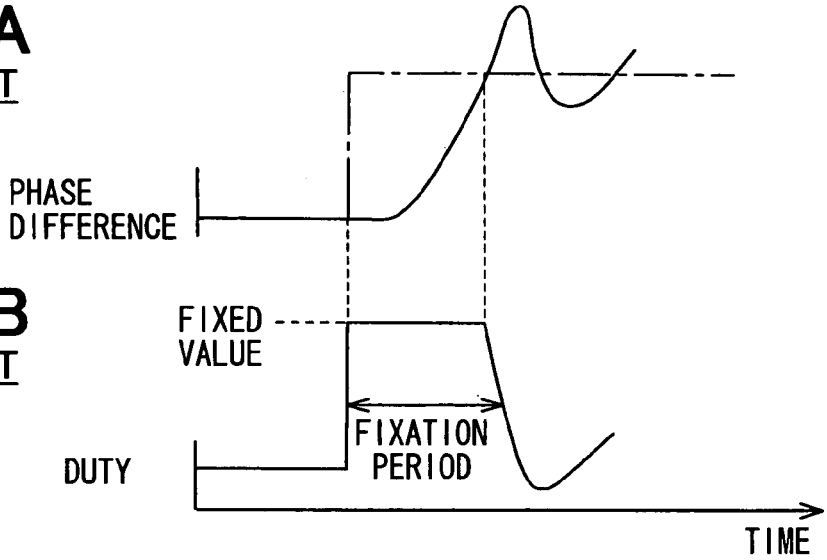
FIG. 5B
PRIOR ART
FIG. 5C
PRIOR ART
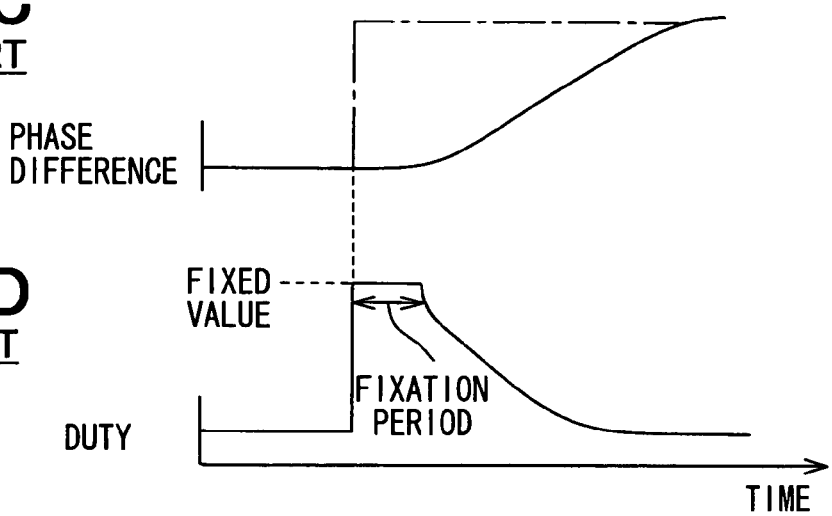
FIG. 5D
PRIOR ART

CONTROL DEVICE FOR ENGINE VALVE AND CONTROL SYSTEM FOR ENGINE

CROSS REFERENCE TO RELATED APPLICATION

This application is based on Japanese Patent Application No. 2006-84662 filed on Mar. 27, 2006, the disclosure of which is incorporated herein by reference.

FIELD OF THE INVENTION

The present invention relates to a control device for an engine valve and a control system for an engine valve which feedback-control a rotational phase difference of a camshaft relative to a crankshaft to obtain a target valve timing.

BACKGROUND OF THE INVENTION

A rotational phase difference-adjusting device varies a rotational phase difference of a camshaft relative to a crankshaft in an internal combustion engine for adjusting operating timing of an engine valve. The rotational phase difference-adjusting device is provided with a variable valve timing mechanism and an oil control valve. The variable valve timing mechanism is usually provided with rotational elements connected respectively to the crankshaft and the camshaft. An advance chamber for advancing a rotational angle of the camshaft and a retard chamber for retarding it are defined in the two rotational elements. The oil control valve is an electromagnetic driven type valve which supplies oil to one of the advance chamber and the retard chamber and discharges it from the other.

On the other hand, a control device for controlling the rotational phase difference, at the time of holding the rotational phase difference, operates the oil control valve to prevent inflow and outflow of oil between the advance chamber and the retard chamber. In addition, at the time of variably controlling the rotational phase difference to a desired value, the control device operates the oil control valve to adjust an inflow amount of the oil to one of the advance chamber and the retard chamber and an outflow amount of the oil from the other.

The variable control for the rotational phase difference actually sets as a reference a holding learning value as an operational signal of the oil control valve which can hold the rotational phase difference and is performed by operating the oil control valve with a feedback correction amount based upon a difference between an actual rotational phase difference and a target value. However, the operational signal which can hold the rotational phase difference changes with a rotational speed of the crankshaft, temperatures of oil or the like. This change invites deterioration in controllability of the feedback control.

Conventionally, there is, as shown in JP-8-74530A (U.S. Pat. No. 5,562,071), proposed a control device which in advance sets the holding learning value for each region of plural regions regionally divided based upon a rotational speed of a crank shaft and temperatures of oil. According to this technology, even if a learning value capable of holding the rotational phase difference in response to the rotational speed or the temperature of the oil changes, an appropriate holding learning value can be used, resulting in maintaining high controllability of the rotational phase difference.

In this case, however, since the holding learning value is required for each region, a great deal of work is to be required for adaptation of the holding learning value.

In view of the above, there exists a need for a control device for an engine valve and a control system for an engine valve which overcome the above mentioned problems in the conventional art. The present invention addresses this need in the conventional art as well as other needs, which will become apparent to those skilled in the art from this disclosure.

SUMMARY OF THE INVENTION

It is an object of the present invention to provide a control device for an engine valve and a control system for an engine valve which change a rotational phase difference of a cam shaft relative to a crank shaft to adjust operating timing of the engine valve, thereby accurately maintaining controllability in the rotational phase difference while restricting an increase in adaptation work at the time of controlling operating timing of the engine valve.

A control device includes a rotational phase difference-adjusting means which changes a rotational phase difference of a camshaft relative to a crankshaft, a crank angle detector for detecting a rotational angle of the crankshaft, and a cam angle detector for detecting a rotational angle of the camshaft.

The device further includes a rotational phase difference-calculating means which calculates the rotational phase difference based upon a detection value of the crank angle detector and a detection value of the cam angle detector.

The device further includes a learning means which learns a holding learning value as an operational signal of the rotational phase difference-adjusting means for holding the rotational phase difference, and a calculating means which calculates a feedback correction amount in accordance with a difference between an actual value and a target value of the rotational phase difference.

The device further includes a control means which feedback-controls the actual value to the target value by operating the rotational phase difference-adjusting means with the feedback correction amount by setting the holding learning value as reference, and an alteration means which alters the holding learning value as the reference only by a specified value on condition that the operational signal for holding the rotational phase difference is assumed to change.

According to the above arrangement, the holding learning value is altered only by the specified value on condition that the operational signal for holding the rotational phase difference is assumed to change. Therefore, even if the operating signal is altered to a side of increasing a difference between the actual value of the rotational phase difference and the target value at the time of changing the actual value of the rotational phase difference for follow-up to the target value, this alteration can be compensated for. As a result, controllability of the rotational phase difference can be accurately maintained with easy adaptation of adapting the predetermined value.

It should be noted that the alteration by this specified value may be made by altering the operational signal to a desired side of the change in the rotational phase difference

BRIEF DESCRIPTION OF THE DRAWINGS

Other objects, features, and advantages of the present invention will become more apparent from the following detailed description made with reference to the accompanying drawings, in which like parts are designated by like reference numbers and in which:

FIGS. 4A and 4B are time charts each showing a state of the control of the rotational phase difference;

FIGS. 5A, 5B, 5C and 5D are time charts each showing a problem of the conventional control;

DETAILED DESCRIPTION OF EMBODIMENTS

First Embodiment

A first embodiment where a control device and a control system for an engine valve according to the present invention are applied to a gasoline engine will be hereinafter described with reference to the accompanying drawings.

Figure 1:
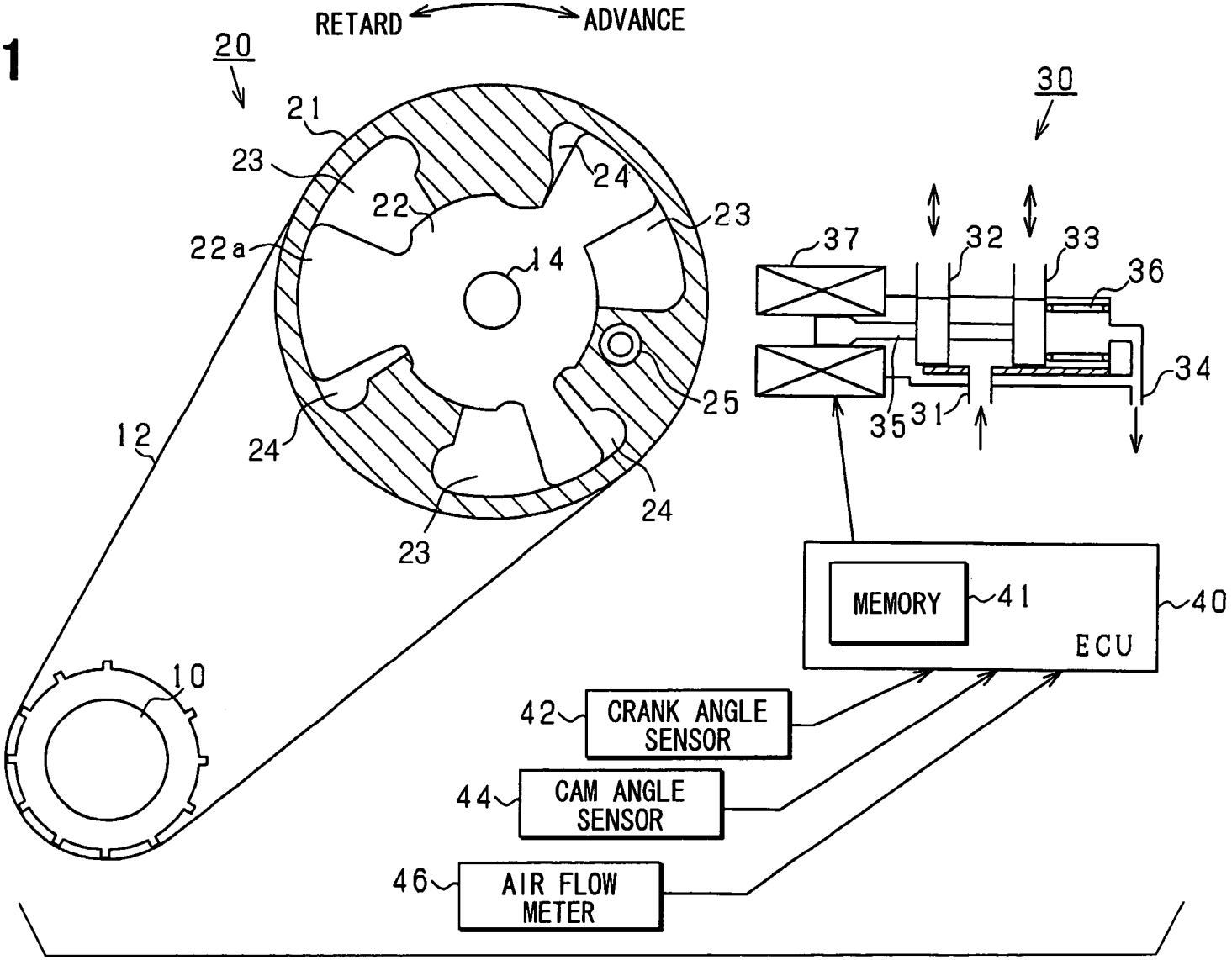
FIG. 1 is a diagram showing a structure of a control system of an engine valve in a first embodiment of the present invention.

FIG. 1 shows an entire structure of a control system for an engine valve in the first embodiment.

As shown in FIG. 1, power of crankshaft 10 is transmitted through a belt 12 and a variable valve timing mechanism 20 to a camshaft 14. The variable valve timing mechanism 20 is provided with a first rotational element 21 connected mechanically to the crank shaft 10 and a second rotational element 22 connected mechanically to the cam shaft 14. In addition, in the first embodiment, the second rotational element 22 is provided with a plurality of projections 22*a* and also is accommodated in the first rotational element 21. Further, a retard chamber 23 and an advance chamber 24 are defined between the projection 22*a* of the second rotational element 22 and an inner wall of the first rotational element 21. The retard chamber 23 is provided for retarding a relative rotational angle (rotational phase difference) of the camshaft 14 to the crankshaft 10 and the advance chamber 24 is provided for advancing the rotational phase difference. The variable valve timing mechanism 20 is further provided with a lock mechanism 25 for fixing the first rotational element 21 and the second rotational element 22 at a rotational phase difference (maximum retard position) where a volume of the retard chamber 23 is maximized.

The variable valve timing mechanism 20 is hydraulically driven by outflow and inflow of oil between the retard chamber 23 and the advance chamber 24. This outflow and the inflow of the oil are adjusted by an oil control valve (OCV 30).

The OCV 30 supplies the oil through a supply path 31 and a retard path 32 or an advance path 33 from a hydraulic pump (not shown) to the retard chamber 23 or the advance chamber 24. In addition, the OCV 30 discharges the oil through the retard path 32 or the advance path 33 and a discharge path 34 from the retard chamber 23 or the advance chamber 24 to an oil pan (not shown). A flow path area of the retard path 32 or the advance path 33 and a flow path area of the supply path 31 or the discharge path 34 are adjusted by a spool 35. That is, the spool 35 is urged to the left side in FIG. 1 by a spring 36 and also receives force for being moved to the right side in FIG. 1 from an electromagnetic solenoid 37. Therefore, a displacement amount of the spool 35 can be operated by applying an operational signal to the electromagnetic solenoid 37 and also adjusting duty of this operational signal.

Control of the rotational phase difference by operating the OCV 30 is performed by an electronic control device (ECU 40). The ECU 40 is structured mainly of a microcomputer. The ECU 40 incorporates detection values representative of various operating conditions of an internal combustion engine, such as a detection value of a crank angle sensor 42 for detecting a rotational angle of the crank shaft 10, a detection value of a cam angle sensor 44 for detecting a rotational angle of the cam shaft 14 and a detection value of an air flow meter 46 for detecting an intake air amount. Then, the ECU 40 performs various calculations based upon these detection values and operates various actuators of the internal combustion engine such as OCV 30 based upon the calculation result.

Further, the ECU 40 is provided with various memories such as a constant storage holding memory 41 for storing and holding data used for the various calculations. Here, the constant storage holding memory 41 is a memory which constantly holds data regardless of presence/absence of an actuating switch of the ECU 40. As the constant storage holding memory 41, there is exemplified a backup memory which is constantly in a power supply state regardless of a state of the actuating switch of the ECU 40 or a memory (EEPROM or the like) which holds data regardless of presence/absence of the power supply.

Hereinafter, control of the rotational phase difference by the ECU 40 will be described in detail.

When the force with which the spring 36 urges the spool 35 to the right direction in FIG. 1 is greater than the force with which a magnetic field of the electromagnetic solenoid 37 displaces the spool 35 in the reverse direction, the spool 35 is displaced in the left direction in FIG. 1. When the spool 35 is displaced to a further left side than a position shown in FIG. 1, the oil is supplied through the supply path 31 and the retard path 32 from the hydraulic pump to the retard chamber 23 and also is discharged through the advance path 33 and the discharge path 34 from the advance chamber 24 to the oil pan. Thereby the second rotational element 22 is rotated in a reverse direction to the clockwise direction in the figure.

On the other hand, when the force with which the magnetic field of the electromagnetic solenoid 37 displaces the spool 35 to the right direction is greater than the force with which the spring 36 urges the spool 35 to the left direction in FIG. 1, the spool 35 is displaced in the right direction in FIG. 1. When the spool 35 is displaced to a further right side than a position shown in FIG. 1, the oil is supplied through the supply path 31 and the advance path 33 from the hydraulic pump to the advance chamber 24 and also is discharged through the retard path 32 and the discharge path 34 from the retard chamber 23 to the oil pan. Thereby the second rotational element 22 is rotated in the clockwise direction in the figure.

As shown in FIG. 1, however, when the spool 35 is placed in a position to close the retard path 32 and the advance path 33, the outflow and inflow of the oil between the retard chamber 23 and the advance chamber 24 are stopped, maintaining the rotational phase difference.

Figure 2:
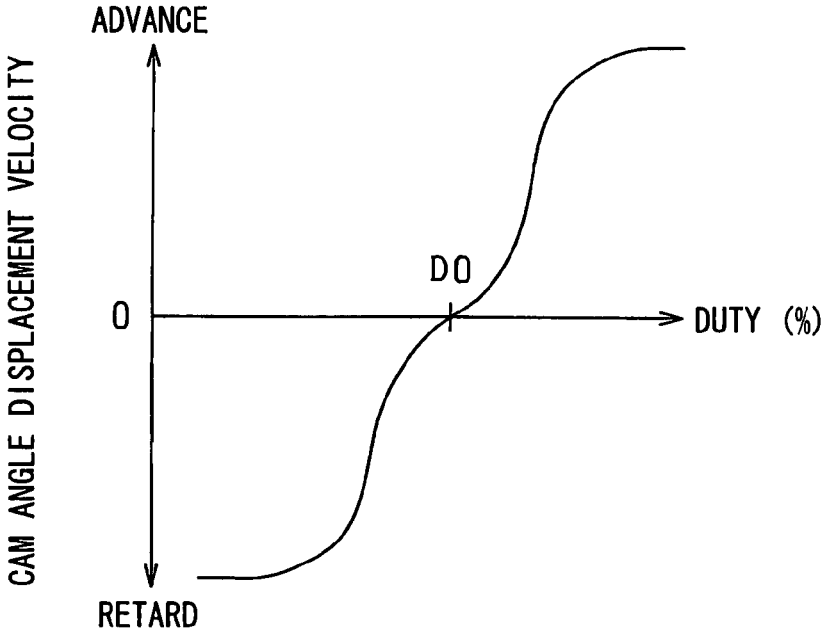
FIG. 2 is a graph showing a relation between an operational signal of an oil control valve and a cam angular displacement velocity in the first embodiment.

As the electromagnetic solenoid 37 of OCV 30 in the ECU 40 is energized, an opening of the spool 35 is operated to control the rotational phase difference. FIG. 2 shows a relation between duty of an operational signal to the electromagnetic solenoid 37 and a displacement velocity of the camshaft 14 to the crankshaft 10.

As shown in FIG. 2, when the duty is "DO", the displacement velocity becomes zero. In other words, when the duty is "DO", the rotational phase difference is maintained. On the other hand, when the duty is smaller than "DO", the camshaft 14 is displaced to the retard side and also as "DO" is smaller, the displacement velocity in the retard side becomes larger. In contrast, when the duty is larger than "DO", the camshaft 14 is displaced to the advance side and also as "DO" is larger, the displacement velocity in the advance side becomes larger.

Therefore, "DO", which is the duty for holding the rotational phase difference, is learned as a holding learning value, and the rotational phase difference is feedback-controlled to the target value on the basis of the holding learning value, thereby appropriately controlling the rotational phase difference to the target value. The holding learning value will be referred to as the HLV, hereinafter. This case, however, raises the problem that the duty for holding the rotational phase difference possibly changes. That is, for example, as a rotational velocity of the crankshaft 10 fluctuates, a value for holding the rotational phase difference possibly changes.

Accordingly, in the first embodiment, on condition that the duty for holding then rotational phase difference is assumed to change, the HLV is altered by a specified value. Hereinafter, this control will be described with reference to FIG. 3.

Figure 3:
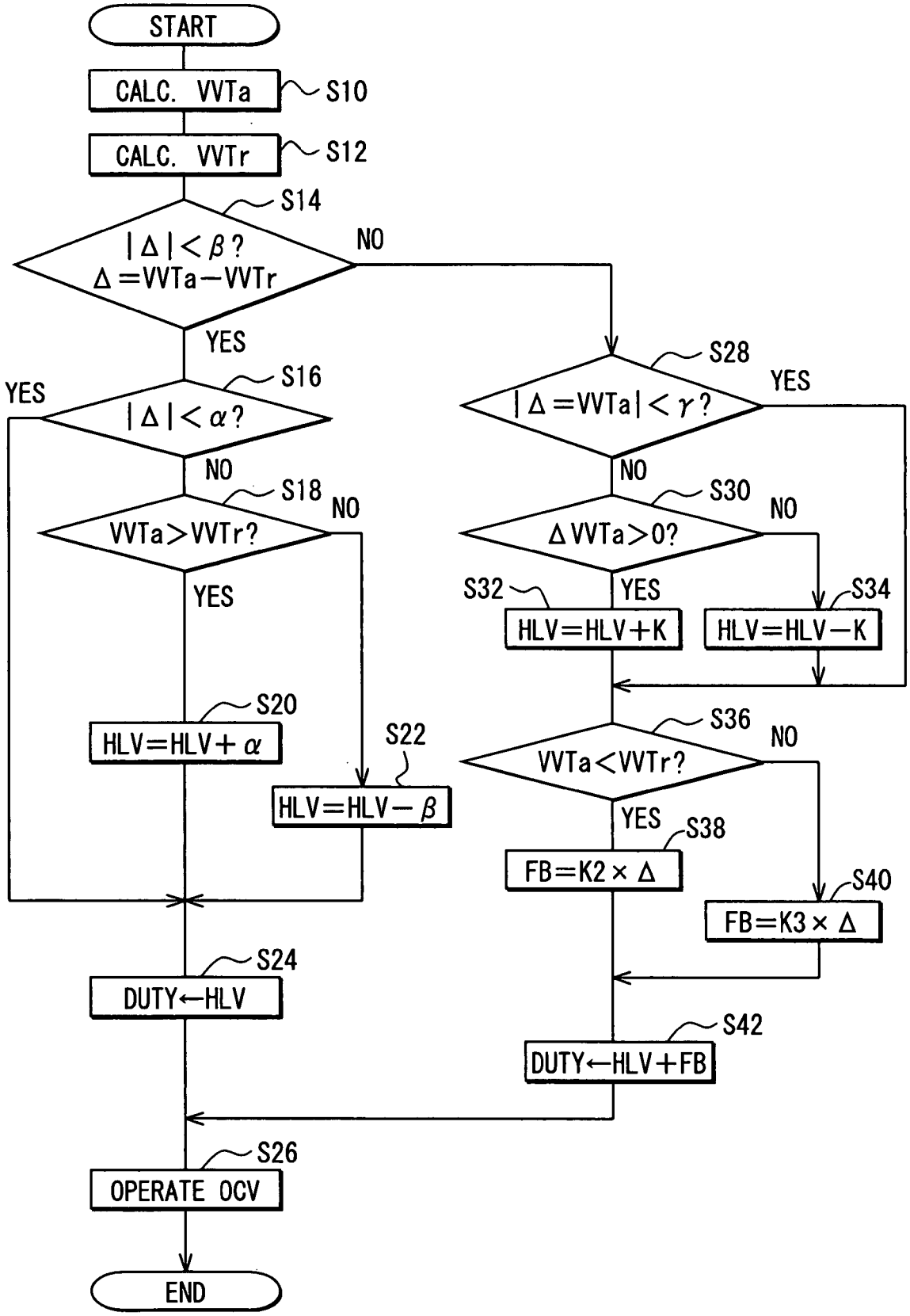
FIG. 3 is a flow chart showing a routine for control of a rotational phase difference in the first embodiment.

FIG. 3 is the routine for control of the rotational phase difference of the camshaft 14 to the crankshaft 10 in the first embodiment. This routine is repeatedly executed in a predetermined cycle by the ECU 40.

In a series of processes in this routine, first in step S10, a target advance value VVTa, which is a target value of a rotational phase difference of the cam shaft 14 to the crank shaft 10, is calculated based upon an engine operating condition such as a rotational velocity of the crank shaft 10 or an intake air amount. The target advance value VVTa is defined as a larger value as the valve timing is further advanced.

In next step S12, an actual advance value VVTr, which is an actual rotational phase difference of the cam shaft 14 to the crank shaft 10, is calculated based upon a detection value of the crank angle sensor 42 and a detection value of the cam angle sensor 44.

In next step S14, it is determined whether or not an absolute value of a difference between the target advance value VVTa and the actual advance value VVTr is less than a predetermined value β. This predetermined value β is to define a threshold value for performing proportional control based upon the difference between the target advance value VVTa and the actual advance value VVTr.

When it is determined that the answer in step S14 is "YES", it is determined that an absolute value of the difference is not as large as to perform proportional control. The process goes to step S16, wherein it is determined whether or not an absolute value of a difference between the target advance value VVTa and the actual advance value VVTr is less than a predetermined value α. This predetermined value α is to define a threshold value of performing integral control for micro-correcting the HLV.

When it is determined that the answer in step S16 is "NO", in step S18 it is determined whether or not the target advance value VVTa is larger than the actual advance value VVTr. In other words, it is determined whether or not the target advance value VVTa is in a further advance side than the actual advance value VVTr. When it is determined that the target advance value VVTa is in the advance side, in step S20 the predetermined value α is added to the HLV to correct the HLV so that the actual advance value VVTr is displaced to the advance side. On the other hand, when it is determined that the target advance value VVTa is in the retard side, in step S22 the predetermined value β is reduced from the HLV to correct the HLV so that the actual advance value VVTr is displaced to the retard side.

When it is determined that when the answer in step S16 is "YES" or when the processes in step S20 and step S22 are completed, the process goes to step 24, wherein the duty at the time of operating OCV 30 is set as a HLV. In step S26 OCV 30 is operated by an operational signal of the duty set in step S24.

On the other hand, when it id determined that the answer in step S14, is "NO", the actual advance value VVTr is feedback-controlled to the target advance value VVTa by the proportional control. Here, first it is determined in step S28 whether or not a changing amount (absolute value) of the target advance value is less than a predetermined value γ. Here, the changing amount, by using the previously calculated target advance value "VVTa(n−1)" and the presently calculated advance value VVTa(n), is calculated as "VVTa (n)−VVTa(n−1)". The predetermined value γ is a value for determining whether or not the condition on which the HLV is assumed to change is met. That is, since the target advance value VVTa is calculated based upon an engine operating condition in step S10, an increasing changing amount of the target advance value VVTa means that an engine operation condition such as a rotational velocity of the crankshaft 10 changes largely.

When an absolute value of the changing amount in step S28 is more than the predetermined value γ, it is determined that the condition on which the HLV is assumed to change is met, and the process goes to step S30. In step S30, it is determined whether or not the changing amount is in the positive, in other words, whether or not the target advance value VVTa has changed to the advance side. In a case where it is determined that the changing amount is in the positive, in step S32 the HLV is corrected to be increased only by a specified value K. As a result, the HLV is corrected in the direction of displacing the actual advance value VVTr to the advance side. On the other hand, in a case where it is determined that the changing amount is in the negative, in step S34 the HLV is corrected to be decreased only by the specified value K. As a result, the HLV is corrected in the direction of displacing the actual advance value VVTr to the retard side.

The predetermined value is set as a value in the range to be assumed to change as the duty for holding the rotational phase difference. In detail, it is set as a value near the maximum value to be assumed as a changing amount of the duty for holding the rotational phase difference due to a change of an engine operating condition such as a rotational velocity in various temperatures in oil.

When it is determined that when the processes in step S32 and step S34 are completed or when it is determined that the answer in step S28 is "YES", the process goes to step 36. In step S36 it is determined whether or not the target advance value VVTa is smaller than the actual advance value VVTr, in other words, whether or not the actual advance value VVTr is advanced relative to the target advance value VVTa. When it is determined that the actual advance value VVTr is advanced, in step S38 a difference Δ of the target advance value VVTa to the actual advance value VVTr is multiplied by a proportional gain K2 to calculate a feedback correction amount. In contrast, when it is determined that the actual advance value VVTr is retarded, in step S40 a difference A of the target advance value VVTa to the actual advance value VVTr is multiplied by a proportional gain K3 to calculate a feedback correction amount. The reason the proportional gain K2 or K3 for each case is used in accordance with a code of the difference Δ of the target advance value VVTa to the actual advance value VVTr is that force required for controlling the rotational phase difference to the advance side is different from force required for controlling the rotational phase difference to the retard side in the variable valve timing mechanism 20. Therefore, in order to equally perform controls of the advance side and the retard side, the proportional gain K2 and K3 are respectively set for each case.

When the processes of step S38 and step S40 are completed, the process goes to step S42. In step S42 the feedback correction amount is added to the HLV to set the duty and the process goes to step S26.

In a series of processes in the routine shown in FIG. 3, the HLV is stored in the constant storage holding memory 41.

In the above structure, when an absolute value of the changing amount in the target advance value VVTa is large, the HLV is altered by the specified value K for restricting the difference of the target advance value VVTa to the actual advance value VVTr, thereby enhancing responsiveness of the actual advance value VVTr with easy adaptation. FIG. 4A shows a change of a rotational phase difference between a camshaft 14 and a crankshaft 10 and FIG. 4B shows a change in duty for holding the rotational phase difference.

When the target advance value VVTa shown in a dashed line in FIG. 4A is increased, the duty is increased therewith. This is because the HLV is increased by K and the feedback correction amount is increased. In addition, after time t2 when the actual advance value VVTr is in close proximity to the target advance value VVTa, the proportional control is stopped and the duty is set to the HLV. Further, the HLV is corrected in accordance with a difference between the target advance value VVTa and the actual advance value VVTr, so that the HLV is newly learned and updated.

Here, the specified value K is, as described above, set to a value near the maximum value of a changing amount which is assumed in the duty for holding the rotational phase difference between the cam shaft 14 and the crank shaft 10. Therefore it is possible to easily perform adaptation of the specified value K. Further, thereby even if the duty for holding the rotational phase difference changes, it is possible to appropriately restrict the follow-up delay to the target advance value VVTa of the actual advance value VVTr due to this change.

On the other hand, as shown in JP-11-62643A, in a case where the duty is fixed to the maximum value or the minimum value at the time of changing the target advance value VVTa, a great deal of work is required for adaptation of the fixation period. FIGS. 5A, 5B, 5C and 5D each show a control state in a case of JP-11-62643A and FIGS. 5A and 5C correspond to FIG. 4A and FIGS. 5B and 5D correspond to FIG. 4B.

That is, when the fixation period is long as shown in FIGS. 5A and 5B, the actual advance value VVTr is overshot. On the other hand, when the fixation period is short as shown in FIGS. 5C and 5D, the responsiveness in control deteriorates. In addition, since an appropriate fixation period changes with an engine operation condition, it is required to adapt an appropriate fixation time for each engine operating condition.

The following effects can be obtained according to the first embodiment described above in detail.

(1) On condition that the duty for holding the rotational phase difference is assumed to change, the HLV is changed only by a specified value K. As a result, even if the duty for holding the rotational phase difference is changed to the side of increasing a difference between the actual advance value VVTr and the target advance value VVTa at the time of displacing the rotational phase difference for the follow-up to the target value, this change can be compensated for. Therefore, controllability in the rotational phase difference can be accurately maintained with easy adaptation of adapting the specified value K.

(2) When an absolute value of the difference Δ between the actual advance value VVTr and the target advance value VVTa is more than a predetermined value α and also an absolute value of the changing amount of the target advance value VVTa is more than a predetermined value γ, the HLV is altered to the follow-up side to the change of the target advance value VVTa. As a result, under a state where deterioration in responsiveness particularly tends to occur, deterioration in the responsiveness can be appropriately restricted.

(3) The specified value K is set to a value near the maximum value in the changing amount assumed in the duty for holding the rotational phase difference, thereby making it possible to appropriately restrict an excessive change of the HLV. As a result, occurrence of the overshooting or the like at the time of controlling the actual advance value VVTr to the target advance value VVTa can be avoided.

Second Embodiment

Mainly a difference of the second embodiment from the first embodiment will be hereinafter described with reference to the accompanying drawings.

Figure 6:
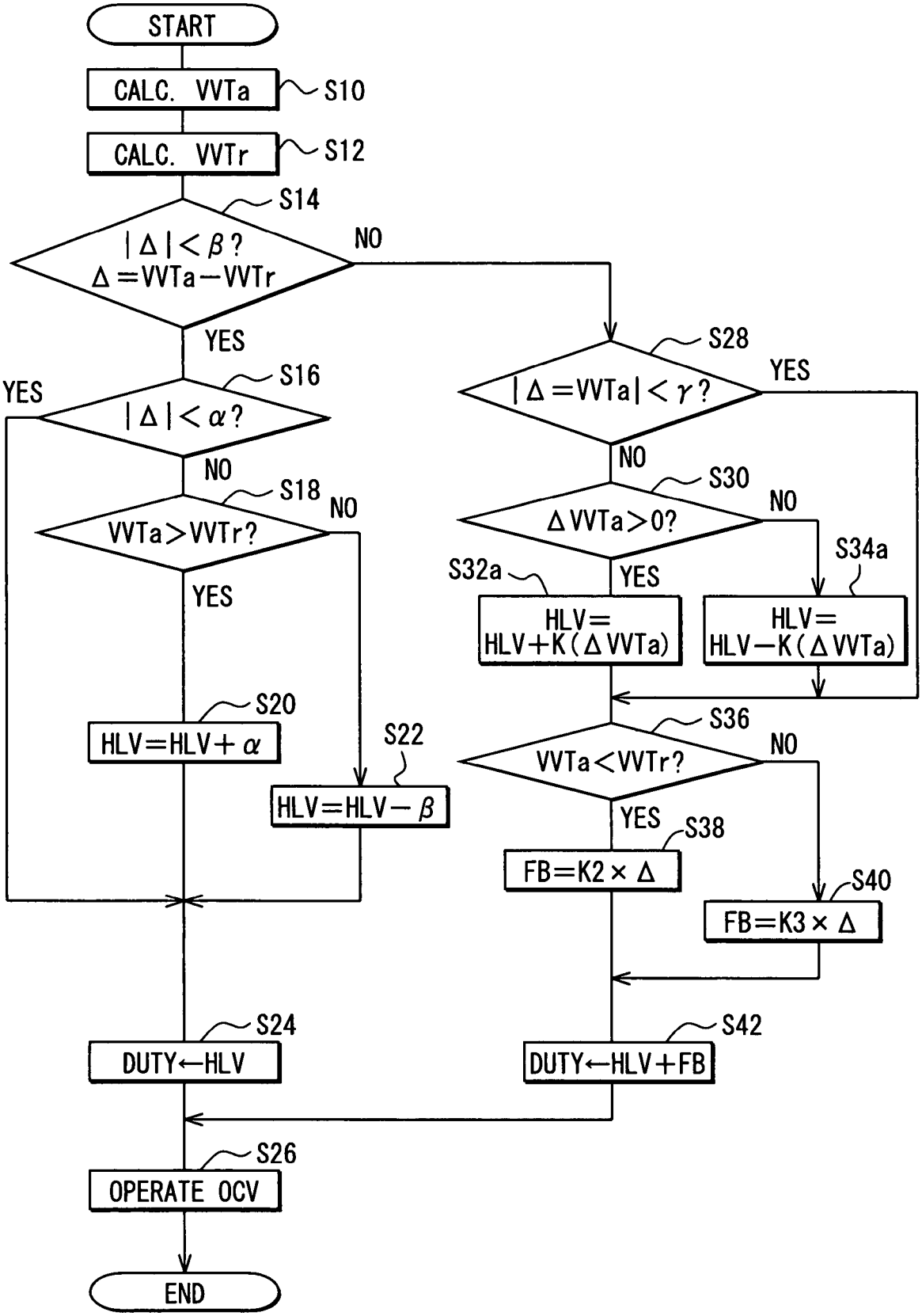
FIG. 6 is a flow chart showing a routine for control of a rotational phase difference in a second embodiment of the present invention.

FIG. 6 shows a routine of control for a rotational phase difference between a camshaft and a crankshaft in the second embodiment. This routine is repeatedly executed for example, in a predetermined cycle by the ECU 40. The processes in FIG. 6 which are the same as those in FIG. 3 are referred to as the same step numbers for convenience.

In the second embodiment, when it is determined in step S28 shown in FIG. 3 described before that the absolute value of the changing amount in the target advance value VVTa is more than the predetermined value γ, the HLV is variably set in response to the changing amount in the target advance value VVTa. This is because since the changing amount of the target advance value VVTa is defined by a changing degree of an engine operating condition, the changing degree of the engine operating condition can be obtained by the changing amount of the target advance value VVTa, resulting in obtaining a changing amount in the duty for holding the rotational phase difference. Therefore, for example, assuming that the changing amount of the duty can be larger as an absolute value of the changing amount of the target advance value VVTa is lager, the specified value K is set to a large value. It is preferable that the maximum value of the specified value K is set to a value near the maximum value assumed as the changing amount of the duty for holding the rotational phase difference.

According to the second embodiment described above, the following effects can be further obtained in addition to the effects (1) and (2) in the first embodiment.

(4) The specified value K is variably set in accordance with the changing amount in the target advance value VVTa, avoiding an excessive alteration of the HLV. As a result, controllability in the rotational phase difference can be further improved.

Third Embodiment

Mainly a difference of the third embodiment from the second embodiment will be hereinafter described with reference to the accompanying drawings.

At the operating of the engine, the target advance value VVTa is basically calculated in step S10 previously shown in FIG. 6 and the actual advance value VVTr is controlled to follow the target advance value VVTa. However, the control to the target advance value VVTa is not always performed in fact and as shown in FIG. 7, there is a case where the actual advance value VVTr is fixed to the maximum retard position.

Figure 7:
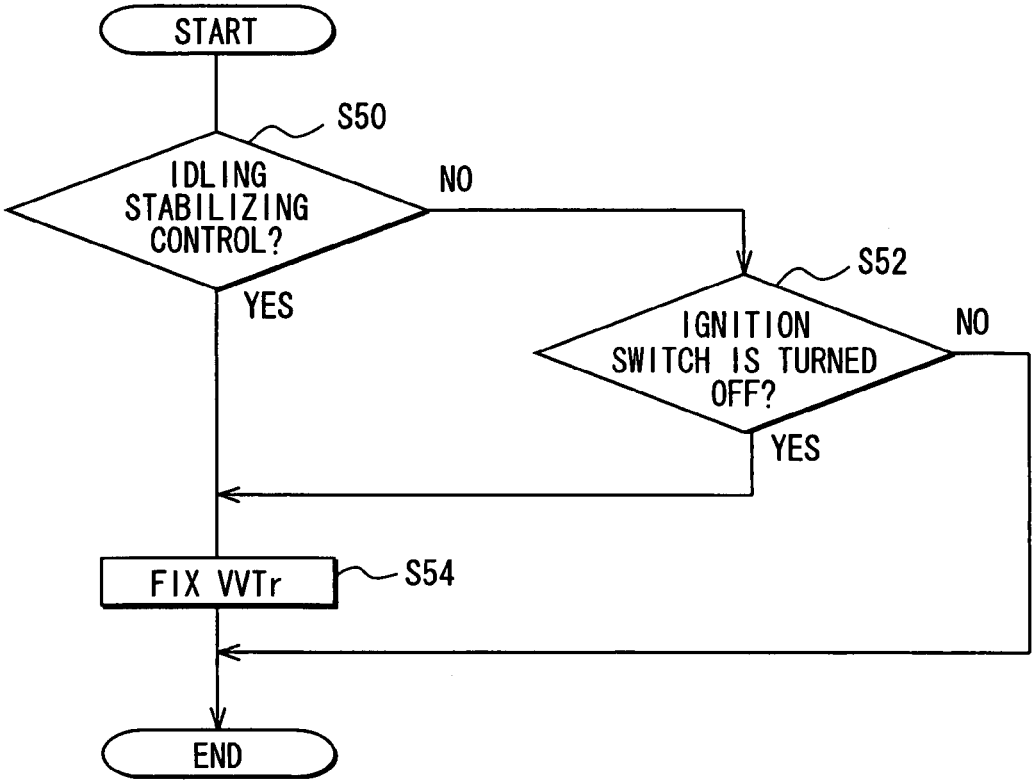
FIG. 7 is a flow chart showing a routine for fixation control of a rotational phase difference in a third embodiment of the present invention.

FIG. 7 shows a routine of control for an actual advance value VVTr in the third embodiment. This routine is repeatedly executed for example, in a predetermined cycle by the ECU 40.

In a series of processes in this routine, an actual advance value VVTr is controlled to be fixed to the maximum retard position when an idling stabilizing control is performed (step S50: YES) and an ignition switch is switched to be OFF (step S52: YES).

Here, when the ignition switch is switched to be OFF, OCV 30 is operated to control the actual advance value VVTr to the maximum retard position and control for fixing the actual advance value VVTr by a lock mechanism 25 is performed as one of subsequent processes (S54) by the ECU 40. When this control is completed, a duty control to OCV 30 is stopped.

In addition, at the idling stabilizing control, OCV 30 is operated to control the actual advance value VVTr to the maximum retard position for restricting power output of the engine. When this process is completed, the duty control to the OCV 30 may be stopped or OCV 30 may be operated with an operational signal of a predetermined duty smaller than the HLV.

When the actual advance value VVTr is fixed in the above structure, in a case where the actual advance value VVTr is controlled again, the HLV possibly changes. That is, for example even if the ignition switch is OFF, the HLV is held in the constant storage holding memory 41, but for the reason of a change in oil temperatures at the engine re-startup or the like, the HLV does not possibly become an appropriate value as the duty for holding the actual advance value VVTr. In addition, when temperatures in oil change even at idling, the HLV changes, so that when the engine operating control changes from the idling stabilizing control to the normal operating control to restart control of the actual advance value VVTr, the HLV does not possibly become an appropriate value.

Figure 8:
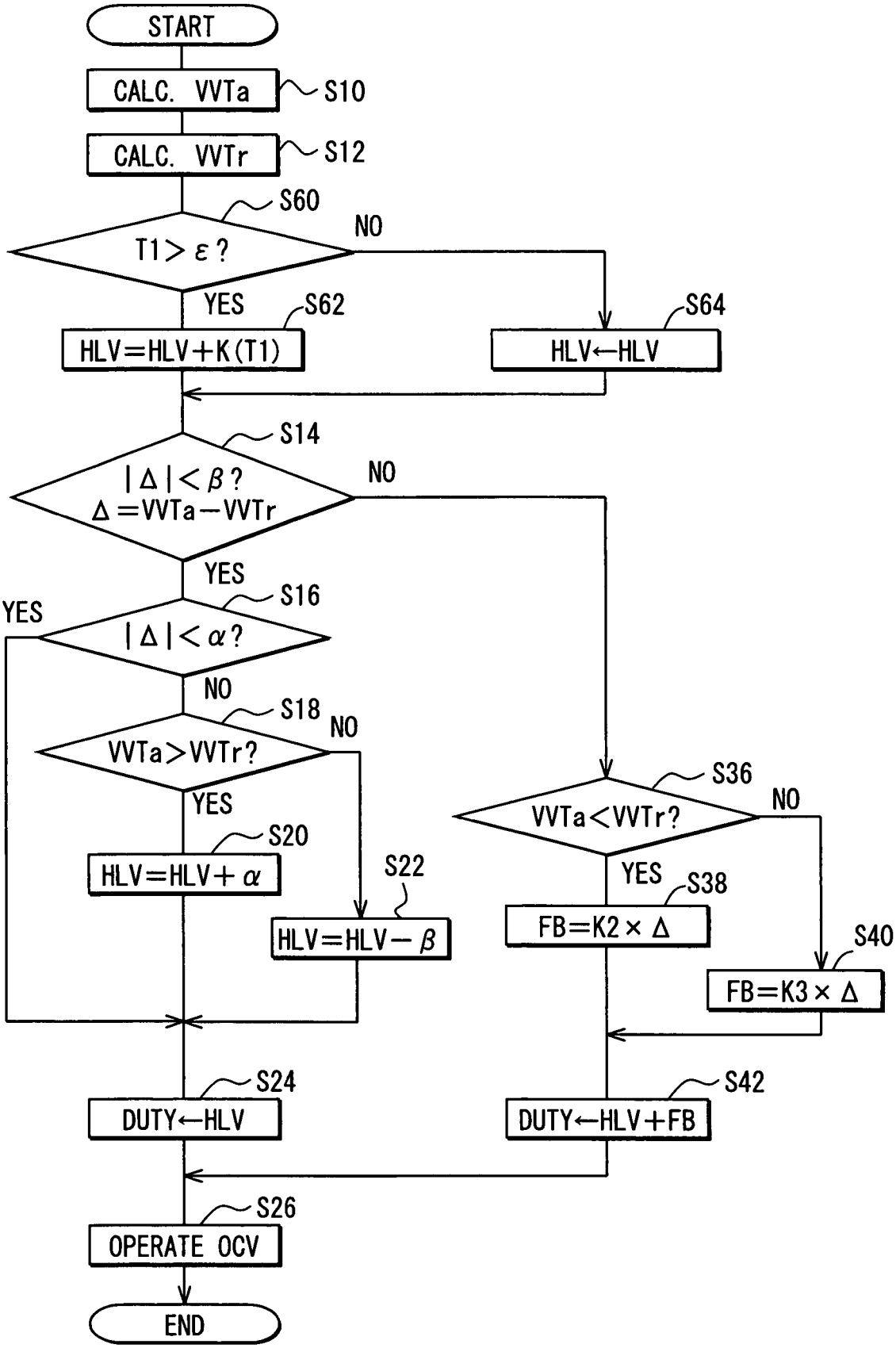
FIG. 8 is a flow chart showing a routine for control of a rotational phase difference in the third embodiment.

Therefore, in the third embodiment the HLV is altered under such condition. FIG. 8 shows the routine for control of a rotational phase difference in the third embodiment. This routine is repeatedly executed for example, in a predetermined cycle by the ECU 40. The processes in FIG. 8 which are the same as those in FIG. 6 are referred to as the same step numerals for convenience.

In a series of processes in the routine, when the processes in step S10 and step S12 shown previously in FIG. 6 are completed, it is determined in step S60 whether or not an engine stop time T1 is longer than a predetermined time $\epsilon$. Here, the engine stop time T1 is time from a point the ignition switch turns off to a point the ignition switch turns on again and is counted by the ECU 40. In addition, the predetermined time $\epsilon$ is a value for determining time when a value for holding the rotational phase value changes due to a change of oil temperatures in OCV 30 is assumed to change. In this process the negative determination is made except that a series of processes in the routine shown in FIG. 8 are for the first time performed after the engine restart-up.

When it is determined that the engine stop time T1 is less than the predetermined time $\epsilon$, in step S64 the HLV stored in the constant storage holding memory 41 is held. On the other hand, when it is determined that the engine stop time T1 is longer than the predetermined time $\epsilon$, in step S62 the HLV is corrected to be increased only by the specified value K. The reason for correcting the HLV for the increasing is that since the actual advance value VVTr is set to the maximum retard position by the routine shown previously in FIG. 7 at the engine restart-up, the actual advance value VVTr is controlled to the advance side.

The specified value K is variably set in accordance with the engine stop time T1. The reason for it is that a changing amount of the duty for holding the rotational phase difference possibly increases caused by that a changing amount in temperatures of oil further increases as the engine stop time T1 is longer. Therefore, in the third embodiment the specified value K is set to a larger value as the engine stop time T1 is longer. It is preferable that the maximum value of the specified value K is set to a value near the maximum value which is assumed as a changing amount of the duty for holding the rotational phase difference.

When processes in step S62 and step 64 are completed, the process goes to step S14 shown previously in FIG. 6. In addition, when the positive determination is made in step S14, processes in steps S16 to S26 in FIG. 6 are executed. When the negative determination is made in step S14, processes in steps S36 to S42, and S26 shown previously in FIG. 6 are executed.

The following effects can be obtained according to the third embodiment described above.

(5) When the engine stop time T1 is more than a predetermined time $\epsilon$, the HLV is altered to the advance side only by a specified value K. As a result, when the actual advance value VVTr is controlled to the advance side after the engine restart-up, the responsiveness delay can be restricted.

(6) A specified value K is variably set in accordance with a fixation period (engine stop time T1) at the maximum retard angle. This allows setting an appropriate specified value K which compensates for a change of the HLV assumed based upon the fixation period. By thus setting the specified value K corresponding to the assumed change, it is possible to avoid an excessive change of the HLV.

Fourth Embodiment

Mainly a difference of the fourth embodiment from the third embodiment will be hereinafter described with reference to the accompanying drawings.

Figure 9:
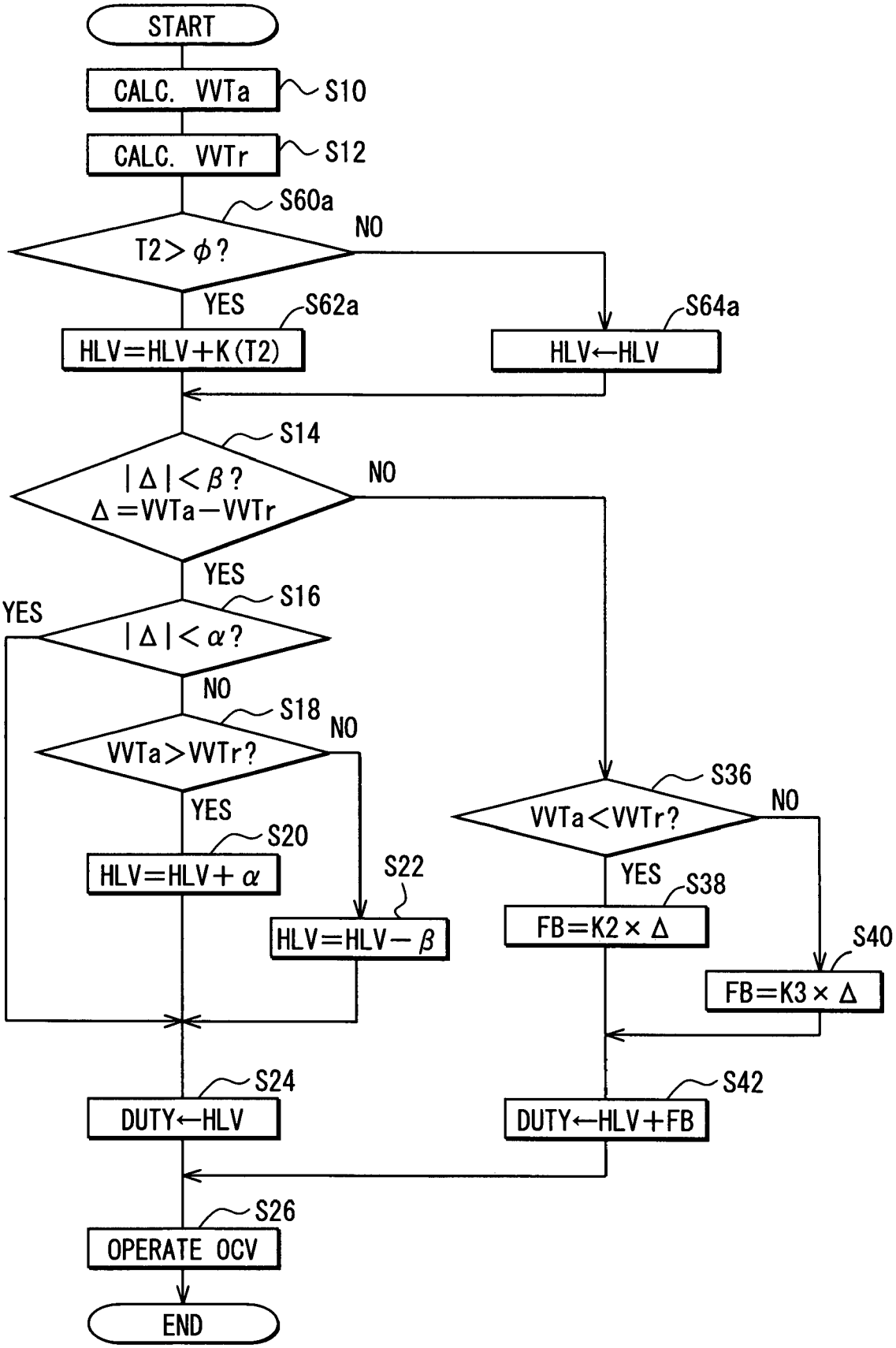
FIG. 9 is a flow chart showing a routine for control of a rotational phase difference in a fourth embodiment of the present invention.

FIG. 9 shows a routine of control for a rotational phase difference between a camshaft and a crankshaft in the fourth embodiment. This routine is repeatedly executed for example, in a predetermined cycle by the ECU 40. The processes in FIG. 9 which are the same as those in FIG. 8 are referred to as the same step numbers for convenience.

In a series of processes in this routine, in step S60*a* in stead of step S60 previously shown in FIG. 8 it is determined whether or not a fixation time T2 for controlling the actual advance value VVTr at the maximum retard position for fixation is longer than a predetermined time $\phi$. Here, the fixation time T2 is time from a point the actual advance value VVTr is controlled to the maximum retard position at idling in the process shown in FIG. 7 to a point the fixation control continues. In addition, the predetermined time $\phi$ is a value for determining time when the HLV due to a change of oil temperatures in OCV 30 is assumed to change. In this process the negative determination is made except for an initial process when the routine in FIG. 9 starts after the idling stabilizing control process.

When it is determined that the fixation time T 2 is less than the predetermined time $\phi$, in step S64*a* the HLV stored in the constant storage memory 41 is held. On the other hand, when it is determined that the fixation time T 2 is more than the predetermined time ϕ, in step S62*a* the HLV is corrected to be increased by a specified value K. The reason for correcting the HLV for the increasing is that since the actual advance value VVTr is set to the maximum retard position by the routine shown previously in FIG. 7 at the idling stabilizing control, when the control of the actual advance value VVTr starts after the idling stabilizing control is finished, the actual advance value VVTr is controlled to the advance side.

The specified value K is variably set in accordance with the fixation time T2. The reason for it is that a changing amount of the duty for holding the rotational phase difference possibly increases caused by that a changing amount in temperatures of oil further increases as the idling stabilizing control is longer. Therefore, in the fourth embodiment the specified value K is set to a larger value as the fixation time T2 is longer. It is preferable that the maximum value of the specified value K is set to a value near the maximum value which is assumed as the changing amount of the duty for holding the rotational phase difference.

When the processes in step S62*a* and step S64*a* are completed, the same as the routine previously shown in FIG. 8, the processes after step S14 are executed.

According to the fourth embodiment described above, the following effects can be further obtained in addition to the effects (6) in the third embodiment.

(7) The fixation time T2 at the maximum retard position of the actual advance value VVTr at the idling stabilizing control is more than a predetermined time ϕ, the HLV is altered to the advance side by a predetermined time K. Thereby, it is possible to restrict the responsiveness delay at the time of controlling the actual advance value VVTr to the advance side after completion of idling operation.

Other Embodiment

Each of the above embodiments may be altered as follows.

(1) In the third embodiment or the fourth embodiment a specified value K may not be variably set in accordance with a fixation period. In this case it is preferable that the specified value K is a value near the maximum value assumed as a changing amount of the duty for holding the rotational phase difference.

(2) In the first embodiment and the second embodiment, when an absolute value of a changing amount in a target advance value VVTa is more than a predetermined value γ, the HLV is altered only by a specified value K. However, when an absolute value of the difference between the actual advance value VVTr and the target advance value VVTa is more than a predetermined value β, the HLV may be always altered. It should be noted that in this case, it is preferable to make a value of the predetermined value β be a value different from that in the first embodiment and the second embodiment to determine whether or not a value for holding the rotational phase difference is assumed to change.

(3) In the first embodiment and the second embodiment, only in a case where the target advance value VVTr is in the further advance side or in the further retard side than the actual advance value VVTr, the HLV may be altered only by a specified value K. In this case, in consideration that the force for advancing an actual advance value VVTr is normally required to be greater than the force for retarding the actual advance value VVTr in the variable valve timing mechanism 20, the HLV may be altered only by a specified value K only in a case where the target advance value VVTa is in the further advance side than the actual advance value VVTr.

Both controls of the third embodiment and the fourth embodiment may be performed or at least one control of the first embodiment and the second embodiment and one control of the third embodiment and the fourth embodiment may be combined.

The rotational phase difference may not be fixed to the vicinity of the maximum retard position at the engine stop or at the idling stabilizing control. Even in this case, when the actual advance value VVTr is controlled to the target advance value VVTa at the engine start-up after the engine stop or at completion of the idling stabilizing control, it is effective to alter the HLV in the displacement direction only by a specified value.

A method of determining a condition where an operational signal of an oil control valve for holding the rotational phase difference is assumed to change is not limited to that illustrated in each of the above embodiments. For example, it may be the condition where a changing amount of a rotational velocity of the crankshaft 10 is more than a predetermined value or a change of temperatures in cooling water of an internal combustion engine having correlation with temperatures in oil is more than a predetermined value.

In each of the above embodiments and the modifications, the specified value K is set within a changing amount assumed in the duty for holding the rotational phase difference, but it is not limited to this. For example, in the second embodiment, for improving the follow-up properties of the actual advance value VVTr to the target advance value VVTa, a specified value K larger than the maximum value of the changing amount may be set to alter the HLV to the side of restricting a difference between the target advance value VVTa and the actual advance value VVTr. According to this, the feedforward control can be performed with the specified value K. Therefore, it is possible to more appropriately perform setting a gain of the feedback control. That is, in a case of the feedback control alone, the gain is required to adapt for a value to meet two requirements as a tradeoff relation, which are an improvement on responsiveness and restriction on control hunting. However, incorporating the feedforward control allows the feedback gain to be set as a value for placing more importance on restriction of the control hunting.

The structure of the variable valve timing mechanism 20 or OCV 30 constituting the rotational phase difference-adjusting means is not limited to that illustrated in FIG. 1. For example, a first rotational element accommodating a second rotational element may rotate integrally with the camshaft 14. In addition, an operational signal of an actuator for the rotational phase difference-adjusting means is not limited to a duty signal, but may be a current signal. Even in this case, when an operational signal for holding the rotational phase difference by the variable valve timing mechanism 20 changes, an application of the present invention is effective. Further, in a case where the rotational phase difference-adjusting means is of a hydraulic driven type, since viscosity of oil changes with temperatures in the oil, resulting in a change in operational signal for holding the rotational phase difference, an application of the present invention is particularly effective.

While only the selected example embodiments have been chosen to illustrate the present invention, it will be apparent to those skilled in the art from this disclosure that various changes and modifications can be made therein without departing from the scope of the invention as defined in the appended claims. Furthermore, the foregoing description of the example embodiments according to the present invention is provided for illustration only, and not for the purpose of limiting the invention as defined by the appended claims and their equivalents.

What is claimed is:

1. A control device of an engine valve comprising:

a rotational phase difference-adjusting means which varies a rotational phase difference of a camshaft relative to a crankshaft to adjust operating timing of an engine valve;

a crank angle detector for detecting a rotational angle of the crankshaft;

a cam angle detector for detecting a rotational angle of the camshaft;

a phase difference-calculating means which calculates the rotational phase difference based upon a detection value of the crank angle detector and a detection value of the cam angle detector;

a learning means which learns a holding learning value as an operational signal of the rotational phase difference-adjusting means for holding the rotational phase difference;

a calculating means which calculates a feedback correction amount in accordance with a difference between an actual value and a target value of the rotational phase difference;

a control means which feedback-controls the actual value to the target value by operating the rotational phase difference-adjusting means with the feedback correction amount by setting the holding learning value as a reference; and an alteration means which alters the holding learning value as the reference only by a specified value on condition that the operational signal for holding the rotational phase difference is assumed to change.

2. A control device of an engine valve according to claim 1, wherein:

when a difference between the actual value and the target value is more than a predetermined value, the alteration means alters the holding learning value to reduce the difference.

3. A control device of an engine valve according to claim 2, wherein:

the alteration means alters the holding learning value when the difference between the actual value and the target value is more than the predetermined value and a changing amount of the target value is more than a predetermined amount.

4. A control device of an engine valve according to claim 3, wherein:

the alteration means variably sets the specified value in accordance with the changing amount.

5. A control device of an engine valve according to claim 1, wherein:

the rotational phase difference is fixed near the maximum retard position under a predetermined condition; and the alteration means alters the holding learning value to an advance side only by the specified value when a fixation period of the rotational phase difference is more than a prescribed period.

6. A control device of an engine valve according to claim 5, wherein:

the alteration means variably sets the specified value in accordance with the fixation period.

7. A control device of an engine valve according to claim 5, wherein:

the predetermined condition is operation stop time of an internal combustion engine;

the phase difference-adjusting means includes a holding mechanism for mechanically holding the rotational phase difference at a value in the vicinity of the maximum retard value;

the alteration means alters the holding learning value to the advance side only by the specified value when the operation stop time is more than a predetermined time.

8. A control device of an engine valve according to claim 5, wherein:

the predetermined condition includes idling operating time.

9. A control device of an engine valve according to claim 1, wherein:

the specified value is set within a changing amount assumed as a value of the operational signal for holding the rotational phase difference.

10. A control device of an engine valve comprising:

a phase difference-adjusting means which varies a rotational phase difference of a cam shaft relative to a crank shaft to adjust operating timing of an engine valve;

a crank angle detector for detecting a rotational angle of the crankshaft;

a cam angle detector for detecting a rotational angle of the camshaft;

a phase difference-calculating means which calculates the rotational phase difference based upon a detection value of the crank angle detector and a detection value of the cam angle detector;

a learning means which learns a holding learning value as an operational signal of the rotational phase difference-adjusting means for holding the rotational phase difference;

a calculating means which calculates a feedback correction amount in accordance with a difference between an actual value and a target value of the rotational phase difference; and a control means which feedback-controls the actual value to the target value by operating the rotational phase difference-adjusting means with the feedback correction amount by setting the holding learning value as a reference; and an alteration means which alters the holding learning value only by a specified value to reduce a difference between the actual value and the target value when the difference is more than a predetermined value.

11. A control device of an engine valve according to claim 10, wherein:

when the difference between the actual value and the target value is more than the predetermined value and a changing amount of the target value is more than a predetermined amount, the alteration means alters the holding learning value only by the specified value to a side for following the change of the target value.

12. A control device of an engine valve according to claim 11, wherein:

the alteration means variably sets the specified value in accordance with the changing amount.

13. A control system of an engine valve comprising:

a phase difference-adjusting means for varying a rotational phase difference of a camshaft relative to a crankshaft to adjust operational timing of the engine valve;

a crank angle detecting means for detecting a rotational angle of the crankshaft;

a cam angle detecting means for detecting a rotational angle of the camshaft;

a phase difference-calculating means for calculating the rotational phase difference based upon a detection value of the crank angle detecting means and a detection value of the cam angle detecting means;

a learning means for learning a holding learning value as an operational signal of the rotational phase difference-adjusting means for holding the rotational phase difference;

a calculating means for calculating a feedback correction amount in accordance with a difference between a target value and an actual value of the rotational phase difference;

a control means for feedback-controlling the actual value to the target value by operating the rotational phase difference-adjusting means with the feedback correction amount by setting the holding learning value as a reference; and an alteration means for altering the holding learning value as the reference only by a specified value on condition that the operational signal for holding the rotational phase difference is assumed to change.

* * * * *